US005320688A

United States Patent [19]

Masumoto et al.

[11] Patent Number: 5,320,688

[45] Date of Patent: Jun. 14, 1994

[54] HIGH STRENGTH, HEAT RESISTANT ALUMINUM-BASED ALLOYS

[75] Inventors: Tsuyoshi Masumoto, 3-8-22 Kamisugi, Sendai-Shi Miyagi; Akihisa Inoue, Sendai; Katsumasa Odera, Toyama; Masahiro Oguchi, Nagano, all of Japan

[73] Assignees: Yoshida Kogyo K. K.; Tsuyoshi Masumoto, Tokyo, Japan; a part interest

[21] Appl. No.: 19,756

[22] Filed: Feb. 19, 1993

Related U.S. Application Data

[62] Division of Ser. No. 723,332, Jun. 28, 1991, Pat. No. 5,240,517, which is a division of Ser. No. 345,677, Apr. 28, 1989, Pat. No. 5,053,085.

[30] Foreign Application Priority Data

Apr. 28, 1988 [JP] Japan ..... 63-103812

[51] Int. Cl.[5] ..... C22C 45/08

[52] U.S. Cl. ..... 148/403; 148/437; 148/438; 420/551; 420/552

[58] Field of Search ..... 148/403, 437, 438; 420/551, 552

[56] References Cited

U.S. PATENT DOCUMENTS

| | | | |
|---|---|---|---|
| 2,656,270 | 10/1953 | Russell | 420/529 |
| 3,791,820 | 2/1974 | Werner | 420/529 |
| 4,435,213 | 3/1984 | Hildeman et al. | 75/249 |
| 4,743,317 | 5/1988 | Skinner et al. | 148/437 |
| 4,787,943 | 11/1988 | Mahajan et al. | 420/552 |
| 4,851,193 | 7/1989 | Mahajan et al. | 420/551 |
| 4,909,867 | 3/1990 | Masumoto et al. | 148/403 |
| 4,950,452 | 8/1990 | Masumoto et al. | 420/550 |
| 5,053,084 | 10/1991 | Masumoto et al. | 148/403 |
| 5,053,085 | 10/1991 | Masumoto et al. | 148/403 |
| 5,074,935 | 12/1991 | Masumoto et al. | 148/403 |

FOREIGN PATENT DOCUMENTS

| | | |
|---|---|---|
| 0289835 | 11/1988 | European Pat. Off. . |
| 0303100 | 2/1989 | European Pat. Off. . |
| 3524276 | 1/1986 | Fed. Rep. of Germany . |
| 62-250147 | 10/1987 | Japan . |
| 62-250148 | 10/1987 | Japan . |
| 2196646 | 5/1988 | United Kingdom . |
| 2196647 | 5/1988 | United Kingdom . |
| 2239874 | 7/1991 | United Kingdom . |

OTHER PUBLICATIONS

Inoue et al, "New Amorphous Alloys with Good Ductility" *Jap. J. Appl. Phys.*, vol. 27, No. 3, Mar. 1988 pp. L280–L282.

Inoue et al, "Aluminum-Based Amorphous Alloys with Tensile", *Jap. J. Appl. Phys.*, vol. 27, No. 4, Apr. 1988, pp. L479–L482.

(List continued on next page.)

*Primary Examiner*—George Wyszomierski

*Attorney, Agent, or Firm*—Hill, Steadman & Simpson

[57] ABSTRACT

The present invention provides high strength, heat resistant aluminum-based alloys having a composition represented by the general formula:

$$Al_aM_bX_c$$

wherein:

M is at least one metal element selected from the group consisting of V, Cr, Mn, Fe, Co, Ni, Cu, Zr, Ti, Mo, W, Ca, Li, Mg and Si;

X is at least one metal element selected from the group consisting of Y, La, Ce, Sm, Nd, Hf, Nb, Ta and Mm (misch metal); and a, b and c are atomic percentages falling within the following ranges:

$$50 \leqq a \leqq 95,\ 0.5 \leqq b \leqq 35 \text{ and } 0.5 \leqq c \leqq 25,$$

the aluminum-based alloy being in an amorphous state, microcrystalline state or a composite state thereof. The aluminum-based alloys possess an advantageous combination of properties of high strength, heat resistance, superior ductility and good processability which make then suitable for various applications.

4 Claims, 1 Drawing Sheet

OTHER PUBLICATIONS

Inoue et al, "Glass Transition Behavior of Al-Y-Ni and Al-Ce-Ni", *Jap. J. Appl. Phys.*, vol. 27, No. 9, Sep. 1988, pp. L1579-L1582.

He et al, "Synthesis and Properties of Metallic Glasses that Contain Aluminum", *Science*, vol. 241, Sep. 23, 1988, pp. 1640-1642.

Shiflet et al, "Mechanical Properties of a New Class of Metallic Glasses", *J. Appl. Phys.*, vol. 64, No. 12, Dec. 15, 1988 pp. 6863-6865.

Ayer et al, "Microstructural Characterization of the Dispersed Phases in Al-Cefe", *Metallurgical Transactions A*, vol. 19A, Jul. 1988, pp. 1645-1656.

Mahajan et al, "Rapidly Solidified Microstructure of Al-8Fe-4 Ianthanide Alloys", *Journal of Materials Science*, vol. 22 (1987), pp. 202-206.

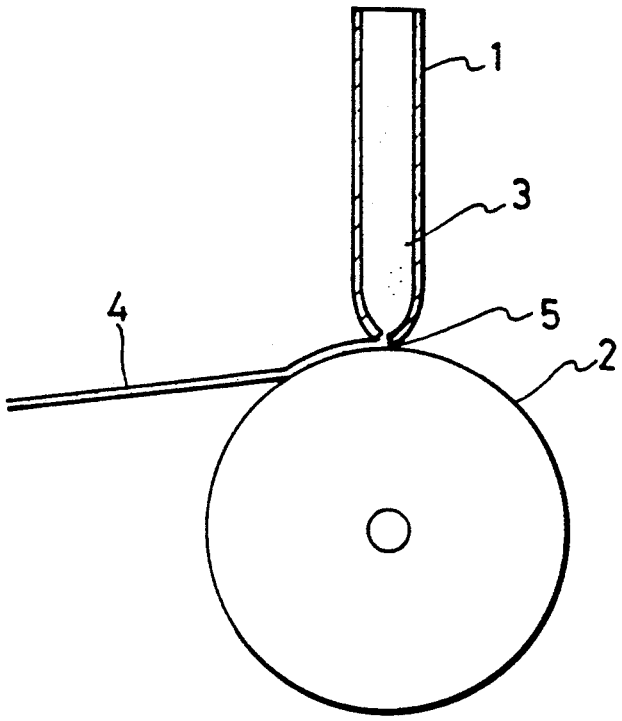
1
3
4
5
2

HIGH STRENGTH, HEAT RESISTANT ALUMINUM-BASED ALLOYS

CROSS REFERENCE TO RELATED APPLICATION

The present application is a division of U.S. Ser. No. 7/723,332 filed Jun. 28, 1991, which issued as U.S. Pat. No. 5,240,517 on Aug. 31, 1993 and which was a division of U.S. Ser. No. 07/345,677, filed Apr. 28, 1989 now U.S. Pat. No. 5,053,085.

BACKGROUND OF THE INVENTION

1. Field of the Invention

The present invention relates to aluminum-based alloys having a desired combination of properties of high hardness, high strength, high wear-resistance and high heat-resistance.

2. Description of the Prior Art

As conventional aluminum-based alloys, there have been known various types of aluminum-based alloys, such as Al-Cu, Al-Si, Al-Mg, Al-Cu-Si, Al-Cu-Mg, Al-Zn-Mg alloys, etc. These aluminum-based alloys have been extensively used in a wide variety of applications, such as structural materials for aircraft, cars, ships or the like; outer building materials, sashes, roofs, etc; structural materials for marine apparatuses and nuclear reactors, etc., according to their properties.

The conventional aluminum-based alloys generally have a low hardness and a low heat resistance. Recently, attempts have been made to impart a refined structure to aluminum-based alloys by rapidly solidifying the alloys and thereby improve the mechanical properties, such as strength, and chemical properties, such as corrosion resistance. However, the rapidly solidified aluminum-based alloys known up to now are still unsatisfactory in strength, heat resistance, etc.

SUMMARY OF THE INVENTION

In view of the foregoing, it is an object of the present invention to provide novel aluminum-based alloys having an advantageous combination of high strength and superior heat-resistance at relatively low cost.

Another object of the present invention is to provide aluminum-based alloys which have high hardness and high wear-resistance properties and which can be subjected to extrusion, press working, a large degree of bending, etc.

According to the present invention, there is provided a high strength, heat resistant aluminum-based alloy having a composition represented by the general formula:

$$Al_aM_bX_c$$

wherein:

M is at least one metal element selected from the group consisting of V, Cr, Mn, Fe, Co, Ni, Cu, Zr, Ti, Mo, W, Ca, Li, Mg and Si;

X is at least one metal element selected from the group consisting of Y, La, Ce, Sm, Nd, Hf, Nb, Ta and Mm (misch metal); and a, b and c are atomic percentages falling within the following ranges:

$$50 \leqq a \leqq 95,\ 0.5 \leqq b \leqq 35 \text{ and } 0.5 \leqq c \leqq 25,$$

wherein said aluminum-based alloy is composed of an amorphous structure or a composite structure consisting of an amorphous phase and a microcrystalline phase, or a microcrystalline composite structure.

The aluminum-based alloys of the present invention are useful as high hardness materials, high strength materials, high electric-resistance materials, good wear-resistant materials and brazing materials. Further, since the aluminum-based alloys exhibit superplasticity in the vicinity of their crystallization temperature, they can be successfully processed by extrusion, press working or the like. The processed articles are useful as high strength, high heat resistant materials in many practical applications because of their high hardness and high tensile strength properties.

BRIEF DESCRIPTION OF THE DRAWING

The single FIGURE is a schematic illustration of a single roller-melting apparatus employed to prepare thin ribbons from the alloys of the present invention by a rapid solidification process.

DETAILED DESCRIPTION OF THE PREFERRED EMBODIMENTS

The aluminum-based alloys of the present invention can be obtained by rapidly solidifying a molten alloy having the composition as specified above by means of liquid quenching techniques. The liquid quenching techniques involve rapidly cooling a molten alloy and, particularly, single-roller melt-spinning technique, twin roller melt-spinning technique and in-rotating-water melt-spinning technique are mentioned as especially effective examples of such techniques. In these techniques, cooling rates of the order of about $10^4$ to $10^6$K/sec can be obtained. In order to produce thin ribbon materials by the single-roller melt-spinning technique or twin roller melt-spinning technique, a molten alloy is ejected from the opening of a nozzle to a roll of, for example, copper or steel, with a diameter of about 30–300 mm, which is rotating at a constant rate within a range of about 300–10000 rpm. In these techniques, various kinds of thin ribbon materials with a width of about 1–300 mm and a thickness of about 5–500 μm can be readily obtained. Alternatively, in order to produce thin wire materials by the in-rotating-water melt-spinning technique, a jet of the molten alloy is directed, under application of a back pressure of argon gas, through a nozzle into a liquid refrigerant layer with a depth of about 1 to 10 cm which is retained by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the relative velocity ratio of the ejecting molten alloy to the liquid refrigerant surface is preferably in the range of about 0.7 to 0.9.

Besides the above techniques, the alloy of the present invention can also obtained in the form of thin film by a sputtering process. Further, rapidly solidified powder of the alloy composition of the present invention can be obtained by various atomizing processes, for example, a high pressure gas atomizing process or a spray process.

Whether the rapidly solidified aluminum-based alloys thus obtained is in an amorphous state, a composite state consisting of an amorphous phase and a microcrystalline phase, or a microcrystalline composite state can be known by an ordinary X-ray diffraction method. Amorphous alloys show hallo patterns characteristic of amorphous structure. Composite alloys consisting of an amorphous phase and a microcrystalline phase show composite diffraction patterns in which hallo patterns and diffraction peaks of the microcrystalline phases are combined. Microcrystalline composite alloys show composite diffraction patterns comprising peaks due to an aluminum solid solution (α-phase) and peaks due to intermetallic compounds depending on the alloy composition.

The amorphous alloys, composite alloys consisting of amorphous and microcrystalline phases, or microcrystalline composite alloys can be obtained by the above-mentioned single-roller melt-spinning, twin-roller melt-spinning, in-rotating-water melt-spinning, sputtering, various atomizing, spray, mechanical alloying, etc. If desired, a mixed-phase structure consisting of an amorphous phase and a microcrystalline phase can be also obtained by proper choice of production process. The microcrystalline composite alloys are, for example, composed of an aluminum matrix solid solution, a microcrystalline aluminum matrix phase and stable or metastable intermetallic phases.

Further, the amorphous structure is converted into a crystalline structure by heating to a certain temperature (called "crystallization temperature") or higher temperatures. This thermal conversion of amorphous phase also makes possible the formation of a composite consisting of microcrystalline aluminum solid solution phases and intermetallic phases.

In the aluminum alloys of the present invention represented by the above general formula, a, b and c are limited to the ranges of 50 to 95 atomic %, 0.5 to 35 atomic % and 0.5 to 25 atomic %, respectively. The reason for such limitations is that when a, b and c stray from the respective ranges, difficulties arise in formation of an amorphous structure or supersaturated solid solution. Accordingly, alloys having the intended properties cannot be obtained in an amorphous state, in a microcrystalline state or a composite state thereof, by industrial rapid cooling techniques using the above-mentioned liquid quenching, etc.

Further, it is difficult to obtain an amorphous structure by rapid cooling process which amorphous structure is crystallized in such a manner as to give a microcrystalline composite structure or a composite structure containing a microcrystalline phase by an appropriate heat treatment or by temperature control during powder molding procedure using conventional powder metallurgy techniques.

The element M is at least one metal element selected from the group consisting of V, Cr, Mn, Fe, Co, Ni, Cu, Zr, Ti, W, Ca, Li, Mg, and Si and these metal elements have an effect in improving the ability to produce an amorphous structure when they coexist with the element X and increase the crystallization temperature of the amorphous phase. Particularly, considerable improvements in hardness and strength are important for the present invention. On the other hand, in the production conditions of microcrystalline alloys, the element M has an effect in stabilizing the resultant microcrystalline phase and forms stable or metastable intermetallic compounds with aluminum element and other additional elements, thereby permitting intermetallic compounds to finely and uniformly dispersed in the aluminum matrix (α-phase). As a result, the hardness and strength of the alloy are considerably improved. Further, the element M prevents coarsening of the microcrystalline phase at high temperatures, thereby offering a high thermal resistance.

The element X is one or more elements selected from the group consisting of Y, La, Ce, Sm, Nd, Hf, Nb, Ta and Mm (misch metal). The element X not only improves the ability to form an amorphous structure but also effectively serves to increase the crystallization temperature of the amorphous phase. Owing to the addition of the element X, the corrosion resistance is considerably improved and the amorphous phase can be retained stably up to high temperatures. Further, in the production conditions of microcrystalline alloys, the element X stabilizes the microcrystalline phases in coexistence with the element M.

Further, since the aluminum-based alloys of the present invention exhibit superplasticity in the vicinity of their crystallization temperatures (crystallization temperature ±100° C.) or in a high temperature region permitting the microcrystalline phase to exist stably, they can be readily subjected to extrusion, press working, hot-forging, etc. Therefore, the aluminum-based alloys of the present invention obtained in the form of thin ribbon, wire, sheet or powder can be successfully consolidated into bulk shape materials by way of extrusion, pressing, hot-forging, etc., at the temperature within the range of their crystallization temperature ±100° C. or in the high temperature region in which the microcrystalline phase is able to stably exist. Further, since the aluminum-based alloys of the present invention have a high degree of toughness, some of them can be bent by 180°.

Now, the advantageous features of the aluminum-based alloys of the present invention will be described with reference to the following examples.

EXAMPLES

A molten alloy 3 having a predetermined composition was prepared using a high-frequency melting furnace and was charged into a quartz tube 1 having a small opening 5 with a diameter of 0.5 mm at the tip thereof, as shown in the Figure. After heating and melting the alloy 3, the quartz tube 1 was disposed right above a copper roll 2. Then, the molten alloy 3 contained in the quartz tube 1 was ejected from the small opening 5 of the quartz tube 1 under the application of an argon gas pressure of 0.7 kg/cm$^2$ and brought into contact with the surface of the roll 2 rapidly rotating at a rate of 5,000 rpm. The molten alloy 3 was rapidly solidified and an alloy thin ribbon 4 was obtained.

According to the processing conditions as described above, there were obtained 39 kinds of aluminum-based alloy thin ribbons (width: 1 mm, thickness: 20 μm) having the compositions (by at. %) as shown in Table. The thin ribbons thus obtained were subjected to X-ray diffraction analysis and, as a result, an amorphous structure, a composite structure of amorphous phase and microcrystalline phase or a microcrystalline composite structure were confirmed, as shown in the right column of the Table.

Crystallization temperature and hardness (Hv) were measured for each test specimen of the thin ribbons and the results are shown in the right column of the Table. The hardness (Hv) is indicated by values (DPN) measured using a micro Vickers Hardness tester under load of 25 g. The crystallization temperature (Tx) is the starting temperature (K) of the first exothermic peak on the differential scanning calorimetric curve which was obtained at a heating rate of 40K/min. In the Table, the following symbols represent:

| | |
|---|---|
| "Amo": | amorphous structure |
| "Amo + Cry": | composite structure of amorphous and microcrystalline phases |
| "Cry": | microcrystalline composite structure |
| "Bri": | brittle |
| "Duc": | ductile |

TABLE

| No. | Specimen | Structure | Tx (K) | Hv (DPN) | Property |
|---|---|---|---|---|---|
| 1. | $Al_{85}Si_{10}Mm_5$ | Amo + Cry | — | 205 | Bri |
| 2. | $Al_{85}Cr_5Mm_{10}$ | Amo | 515 | 321 | Bri |
| 3. | $Al_{88}Cr_5Mm_7$ | Amo + Cry | — | 275 | Bri |
| 4. | $Al_{85}Mn_5Mm_{10}$ | Amo | 580 | 359 | Duc |
| 5. | $Al_{80}Fe_{10}Mm_{10}$ | Amo | 672 | 1085 | Bri |
| 6. | $Al_{85}Fe_5Mm_{10}$ | Amo | 625 | 353 | Duc |
| 7. | $Al_{88}Fe_9Mm_3$ | Amo | 545 | 682 | Duc |
| 8. | $Al_{90}Fe_5Mm_5$ | Amo + Cry | — | 384 | Bri |
| 9. | $Al_{88}Co_{10}Mm_2$ | Amo | 489 | 270 | Duc |
| 10. | $Al_{85}Co_5Mm_{10}$ | Amo | 630 | 325 | Duc |
| 11. | $Al_{80}Ni_{10}Mm_{10}$ | Amo | 643 | 465 | Duc |
| 12. | $Al_{72}Ni_{18}Mm_{10}$ | Amo | 715 | 534 | Bri |
| 13. | $Al_{65}Ni_{25}Mm_{10}$ | Amo | 753 | 643 | Bri |
| 14. | $Al_{90}Ni_5Mm_5$ | Amo + Cry | — | 285 | Duc |
| 15. | $Al_{85}Ni_5Mm_{10}$ | Amo | 575 | 305 | Duc |
| 16. | $Al_{80}Cu_{10}Mm_{10}$ | Amo | 452 | 384 | Bri |
| 17. | $Al_{85}Cu_5Mm_{10}$ | Amo | 533 | 315 | Duc |
| 18. | $Al_{80}Nb_{10}Mm_{10}$ | Amo | 475 | 213 | Duc |
| 19. | $Al_{85}Nb_5Mm_{10}$ | Amo | 421 | 163 | Duc |
| 20. | $Al_{80}Nb_5Ni_5Mm_{10}$ | Amo | 635 | 431 | Bri |
| 21. | $Al_{80}Fe_5Ni_5Mm_{10}$ | Amo | 683 | 921 | Bri |
| 22. | $Al_{80}Cr_3Cu_7Mm_{10}$ | Amo | 532 | 348 | Bri |
| 23. | $Al_{92}Ni_3Fe_2Mm_3$ | Cry | — | 234 | Duc |
| 24. | $Al_{93}Fe_2Y_5$ | Amo + Cry | — | 208 | Duc |
| 25. | $Al_{88}Cu_2Y_{10}$ | Amo | 485 | 289 | Duc |
| 26. | $Al_{93}Co_2La_5$ | Amo | 454 | 262 | Duc |
| 27. | $Al_{93}Co_5La_2$ | Amo + Cry | — | 243 | Duc |
| 28. | $Al_{93}Fe_5Y_2$ | Amo + Cry | — | 271 | Duc |
| 29. | $Al_{93}Fe_2La_5$ | Amo + Cry | — | 240 | Duc |
| 30. | $Al_{93}Fe_5La_2$ | Amo + Cry | — | 216 | Duc |
| 31. | $Al_{88}Ni_{10}La_2$ | Amo | 534 | 284 | Bri |
| 32. | $Al_{88}Cu_6Y_6$ | Amo + Cry | — | 325 | Duc |
| 33. | $Al_{90}Ni_5La_5$ | Amo + Cry | — | 317 | Duc |
| 34. | $Al_{92}Co_4Y_4$ | Amo + Cry | — | 268 | Duc |
| 35. | $Al_{90}Ni_5Y_5$ | Amo | 487 | 356 | Duc |
| 36. | $Al_{90}Cu_5La_5$ | Cry | — | 324 | Duc |
| 37. | $Al_{88}Cu_7Ce_5$ | Cry | — | 305 | Bri |
| 38. | $Al_{88}Cu_7Ce_5$ | Amo | 527 | 360 | Duc |
| 39. | $Al_{90}Fe_5Ce_5$ | Amo | 515 | 313 | Duc |

As shown in Table, the aluminum-based alloys of the present invention have an extremely high hardness of the order of about 200 to 1000 DPN, in comparison with the hardness Hv of the order of 50 to 100 DPN of ordinary aluminum-based alloys. It is particularly noted that the aluminum-based alloys of the present invention have very high crystallization temperatures Tx of at least 400K and exhibit a high heat resistance.

The alloy Nos. 5 and 7 given in the Table were measured for the strength using an Instron-type tensile testing machine. The tensile strength measurements showed about 103 kg/mm$^2$ for the alloy No. 5 and 87 kg/mm$^2$ for the alloy No. 7 and the yield strength measurements showed about 96 kg/mm$^2$ for the alloy No. 5 and about 82 kg/mm$^2$ for the alloy No. 7. These values are twice the maximum tensile strength (about 45 kg/mm$^2$) and maximum yield strength (about 40 kg/mm$^2$) of conventional age-hardened Al-Si-Fe aluminum-based alloys. Further, reduction in strength upon heating was measured for the alloy No. 5 and no reduction in the strength was detected up to 350° C.

The alloy No. 36 in the Table was measured for the strength using the Instron-type tensile testing machine and there were obtained the results of a strength of about 97 kg/mm$^2$ and a yield strength of about 93 kg/mm$^2$.

The alloy No. 39 shown in the Table was further investigated for the results of the thermal analysis and X-ray diffraction and it has been found that the crystallization temperature Tx(K), i.e., 515K, corresponds to crystallization of aluminum matrix (α-phase) and the initial crystallization temperature of intermetallic compounds is 613K. Utilizing such properties, it was tried to produce bulk materials. The alloy thin ribbon rapidly solidified was milled in a ball mill and compacted in a vacuum of $2\times10^{-3}$ Torr at 473K by vacuum hot pressing, thereby providing an extrusion billet with a diameter of 24 mm and a length of 40 mm. The billet had a bulk density/true density ratio of 0.96. The billet was placed in a container of an extruder, held for a period of 15 minutes at 573K and extruded to produce a round bar with an extrusion ratio of 20. The extruded article was cut and then ground to examine the crystalline structure by X-ray diffraction. As a result of the X-ray examination, it has been found that diffraction peaks are those of a single-phase aluminum matrix (α-phase) and the alloy consists of single-phase solid solution of aluminum matrix free of second-phase of intermetallic compounds, etc. Further, the hardness of the extruded article was on a high level of 343 DPN and a high strength bulk material was obtained.

Although various minor modifications may be suggested by those versed in the art, it should be understood that we wish to embody within the scope of the patent granted hereon all such modifications as reasonably and properly come within the scope of our contribution to the art.

We claim:

1. A rapidly solidified, high strength, heat resistant aluminum-based alloy having a composition represented by the general formula:

$$Al_aM_{1b}X'_c$$

wherein $M_1$ is at least one metal element selected from the group consisting of V, Cr, Mn, Co, Ni, Cu, Zr, Ti, Mo, W, Ca, Li, Mg and Si;

X' is at least one metal element selected from the group consisting of Ce, Sm, Nd and Mm (misch metal); and a, b and c are atomic percentages falling within the following ranges:

$$50\leqq a\leqq 95,\ 0.5\leqq b\leqq 35 \text{ and } 0.5\leqq c\leqq 25,$$

wherein said aluminum-based alloy is composed of a microcrystalline composition structure consisting of an aluminum matrix solid solution, a microcrystalline aluminum matrix phase and a stable or metastable intermetallic phase.

2. A rapidly solidified, high strength, heat resistant aluminum-based alloy having a composition represented by the general formula:

$$Al_aM_{1b}X'_{c1}X''_{c2}$$

wherein:

$M_1$ is at least one metal element selected from the group consisting of V, Cr, Mn, Co, Ni, Cu, Zr, Ti, Mo, W, Ca, Li, Mg and Si;

X' is at least one metal element selected from the group consisting of Ce, Sm, Nd and Mm (misch metal);

X'' is at least one metal element selected from the group consisting of Y and La; and a, b, c1 and c2 are atomic percentages falling within the following ranges:

$$50 \leqq a \leqq 95,\ 0.5 \leqq b \leqq 35 \text{ and } 0.5 \leqq c = c2 + c2 \leqq 25,$$

wherein said aluminum-based alloy is composed of a microcrystalline composition structure consisting of an aluminum matrix solid solution, a microcrystalline aluminum matrix phase and a stable or metastable intermetallic phase.

3. A rapidly solidified, high strength, heat resistant aluminum-based alloy having a composition represented by the general formula:

$$Al_a M_1'_b X''_c$$

wherein:

$M_1'$ is at least one metal element selected from the group consisting of V, Cr, Mn, Zr, Ti, Mo, W, Ca, Li, Mg and Si;

X'' is at least one metal element selected from the group consisting of Y and La; and a, b and c are atomic percentages falling within the following ranges:

$$50 \leqq a \leqq 95,\ 0.5 \leqq b \leqq 35 \text{ and } 0.5 \leqq c \leqq 25,$$

wherein said aluminum-based alloy is composed of a microcrystalline composite structure consisting of an aluminum matrix solid solution, a microcrystalline aluminum matrix phase and a stable or metastable intermetallic phase.

4. A rapidly solidified, high strength, heat resistant aluminum-based alloy having a composition represented by the general formula:

$$Al_a M_1'_{b1} M_1''_{b2} X_c$$

wherein:

$M_1'$ is at least one metal element selected from the group consisting of V, Cr, Mn, Zr, Ti, Mo, W, Ca, Li, Mg and Si;

$M_1''$ is at least one metal element selected from the group consisting of Co, Ni and Cu;

X is at least one metal element selected from the group consisting of Y, La, Ce, Sm, Nd and Mm (misch metal); and a, b1, b2 and c are atomic percentages falling within the following ranges:

$$50 \leqq a \leqq 95,\ 0.5 \leqq b = b1 + b2 \leqq 35 \text{ and } 0.5 \leqq c \leqq 25,$$

wherein said aluminum-based alloy is composed of a microcrystalline composite structure consisting of an aluminum matrix solid solution, a microcrystalline aluminum matrix phase and a stable or metastable intermetallic phase.

* * * * *